US007739862B2

(12) United States Patent
König

(10) Patent No.: US 7,739,862 B2
(45) Date of Patent: Jun. 22, 2010

(54) YARN CLAMPING DEVICE FOR UNDERWINDING YARNS ON SPINDLES OF A RING SPINNING OR RING TWISTING MACHINE

(76) Inventor: Günter König, Am Kugelrain 11, D-73066, Uhingen (DE)

( * ) Notice: Subject to any disclaimer, the term of this patent is extended or adjusted under 35 U.S.C. 154(b) by 0 days.

(21) Appl. No.: 12/096,704

(22) PCT Filed: Dec. 8, 2006

(86) PCT No.: PCT/EP2006/011841

§ 371 (c)(1),
(2), (4) Date: Jul. 2, 2008

(87) PCT Pub. No.: WO2007/065703

PCT Pub. Date: Jun. 14, 2007

(65) Prior Publication Data

US 2008/0276592 A1 Nov. 13, 2008

(30) Foreign Application Priority Data

Dec. 8, 2005 (DE) ..... 10 2005 059 041
Dec. 19, 2005 (DE) ..... 10 2005 061 043

(51) Int. Cl.
*D01H 7/52* (2006.01)

(52) U.S. Cl. ..... 57/75; 57/112

(58) Field of Classification Search ..... 57/75, 57/112; 242/475.7, 476, 476.1, 476.6
See application file for complete search history.

(56) References Cited

U.S. PATENT DOCUMENTS 4,005,567 A * 2/1977 Mariani ..... 57/299
4,796,422 A * 1/1989 Odawara ..... 57/299
4,896,841 A * 1/1990 Topuett ..... 242/476
6,085,511 A * 7/2000 Dinkelmann et al. ..... 57/135
6,289,662 B1 * 9/2001 Dinkelmann et al. ..... 57/299

FOREIGN PATENT DOCUMENTS

JP 63295726 A 12/1988
JP 1174623 A 7/1989
JP 278580 U 6/1990
JP 3025572 U 3/1991

* cited by examiner

*Primary Examiner*—Shaun R Hurley
(74) *Attorney, Agent, or Firm*—Laurence A. Greenberg; Werner H. Stemer; Ralph E. Locher

(57) ABSTRACT

The invention relates to a thread clamping device for lower winding threads on spindles of a ring spinning frame or ring twisting frame. A clamping sleeve is provided between a clamping ring and a radially protruding flange on the spindle which can be axially displaced between a clamping position, which is defined by the position on the clamping ring, and an open position. The clamping sleeve is associated with an actuation device for the axial displacement thereof, which co-operates with radially extending means on the clamping sleeve. The clamping sleeves are associated with elements for fixing the position thereof at least in the clamping position. The aim of the invention is to introduce lower windings into the clamping gap and to improve the removal thereof from the clamping gap. As a result, the actuation elements and/or the radially protruding means are maintained on the clamping sleeve in a radially, elastically touching manner in relation to each spindle axis and are provided with rising sloping surfaces which are radially effective in both relative directions of movement.

9 Claims, 7 Drawing Sheets

YARN CLAMPING DEVICE FOR UNDERWINDING YARNS ON SPINDLES OF A RING SPINNING OR RING TWISTING MACHINE

BACKGROUND OF THE INVENTION

Field of the Invention

The invention relates to a yarn clamping device for underwinding yarns on spindles of a ring spinning or ring twisting machine wherein a clamping ring and at a distance therebelow a radially protruding collar are provided on the spindle under an underwinding crown; wherein an axially displaceable clamping sleeve is located between the clamping ring and the collar on the spindle; wherein the clamping sleeve can be displaced by means of an actuating device between a clamping position defined by the contact against the clamping ring and an open position defined by the contact against the collar for opening or closing a clamping cleft; and wherein the clamping sleeve is equipped with radially extending means for the operation of the actuating elements of the actuating device and with elements for fixing the position of the clamping sleeve at least in the closed position.

A similar kind of device is already known by publication EP 1 218 577 B1. The clamping sleeve is equipped with permanent magnets which, in order to secure the closed position, fix the clamping sleeve on the clamping ring below the underwinding crown. If the clamping cleft is to be opened, the clamping sleeve will move to the lower, open position by means of an actuating device which acts on a radially protruding collar of the clamping sleeve by means of actuating elements, thereby overcoming the magnetic forces. In the open position magnetic forces of the magnets integrated into the clamping sleeve will in turn become active and will hold the clamping sleeve on the lower collar of the spindle. The actuating device is not described in detail in publication EP 1 218 577 B1.

Common actuating devices for adjusting the clamping sleeve are described, among others, in publication EP 0 775 769 B1. Actuating means which act on radially protruding means of the clamping sleeve via levers and transport the clamping sleeve into the positions required by the functioning of the system are mounted on parts that are firmly fixed to the machine frame. These known devices share the feature that the actuating devices act on one side and/or eccentrically on the clamping sleeves. This eccentric action requires long guides of the clamping sleeves along the spindle axles. Therefore, a limitation of the spindle speed is quite often also required. Another disadvantage is the high amount of additionally required structural outlay for these devices, which is also shown by the devices described in the publications EP 587 526 A1 and DE 199 04 793 C1.

Publication EP 462 467 B1 also discloses an actuating device which uses a ring rail on its way to the underwinding position for moving the clamping sleeve from the closed position to the open position. For each spindle the ring rail is equipped in the region of each spindle on its lower side with a projecting part which presses on the radially protruding collar of the clamping sleeve when the ring rail is approaching the underwinding position. This action compresses an axially acting pressure spring which is called "retroactive element" to the maximum width of the clamping cleft, thus opening the clamping cleft for the insertion of the underwinding yarn spiral. Except during this described procedure, the spring constantly keeps the clamping sleeve in the closed position, which is also called "working position". During the short opening of the clamping cleft the yarn end still held in the cleft is released and the new underwinding yarn spiral is inserted almost simultaneously. The spindles run at very low speed during this opening procedure, because the underwinding should show a yarn loop of less than 360°. Ejecting and removing the yarn ends from the clamping cleft overlaps to a certain extent with the application of the new underwinding yarn spiral and is therefore not reliable. Frequent machine standstills for cleaning are the result.

Publication DE 196 28 826 A1 describes a yarn clamping device with a clamping sleeve which slides vertically displaceably on the shaft of the spindle wharve. A pressure spring, which is supported on the lower side of the wharve collar, presses the front surface of the clamping sleeve upwards against the clamping ring and closes the clamping cleft. Between an upper ring-shaped surface inclined inwards and downwards on the clamping sleeve, there are ball-shaped centrifugal elements with a relatively small diameter of max. 3 mm, which are located in the clamping position with their upper vertex a short distance from the lower side of the clamping ring. The centrifugal elements are guided in radial grooves of the clamping ring which are open underneath.

When the cop spinning process is finished, the ring rail lowers. The yarn guided by the traveler of the spinning ring is inserted at slowly decreasing spindle speed, approx. 5000/min, into the clamping cleft which is to be kept open by the centrifugal elements. If the spindle falls below this speed, the spring will close the clamping cleft, because it has to generate the complete clamping force for the underwound yarn upon cop change.

During the following start of yarn spinning for the new bobbin or cop, the centrifugal elements guided on the clamping ring move outwards due to the rotation of the spindle. They only open the clamping cleft after having reached approx. 5000 spindle rpm and also only to a small extent.

Therefore, this device is highly disadvantageous. The pressure spring, which has to apply the complete clamping force for the underwindings in the state of highest extension, can be overcome by the centrifugal elements only at high speeds. This means that also the underwinding process has to take place at these high speeds. The large mass of spindles and drawing sections, however, does not allow a sudden standstill out of this speed range, which would be absolutely necessary for limiting the looping of the underwinding to 270° up to a max. of 360°.

The consequence is that at relatively low speed the underwinding yarn is deposited only in the wedge-shaped area in front of the already closed clamping cleft and thus it is not sufficiently clamped. This considerably disrupts cop change. The spinning of the new cop is not effected with the required reliability.

If, in contrary, the underwinding yarn is inserted at a speed of more than 5000/min and clamped in the clamping cleft, clearly more than one winding will be deposited in the clamping cleft and several spirals will regularly be wound on the clamping sleeve. Removing these additional spirals from the clamping cleft and from the clamping sleeve creates considerable problems. In most cases the start of winding the new tube is also hindered. Yarn breakages and losses of production are the result.

The publications DE 197 46 819 A1 and DE 198 07 740 A1 disclose devices for clamping the underwindings during the bobbin change and for releasing the underwindings to be removed. These devices dispense with a clamping sleeve which can be displaced by means of actuating elements. Instead of the clamping sleeve, this system uses an elastic O-Ring for clamping which, due to the centrifugal force, is supported at high spindle speeds on the inner side of a ring at a distance from the clamping surface on the spindle and thus opens the clamping cleft. Such a design is unsatisfactory because the underwinding threads can only be inserted into the wedge-shaped clamping cleft which is closed at low speeds. Also a specific control of the delivery speed during this phase does not lead to a satisfactory safety of the clamping procedure during cop change.

BRIEF SUMMARY OF THE INVENTION

The object of the present invention is to propose an actuating device for a yarn clamping device equipped with a clamping sleeve which allows the reliable removal of the yarn waste from the clamping cleft and the reliable and safe clamping of a new underwinding thread with a circumference angle smaller than 360° until the winding procedure for the newly placed tube has begun.

This object is achieved by a yarn clamping device for underwinding yarns on spindles of a ring spinning or ring twisting machine wherein a clamping ring and at a distance therebelow a radially protruding collar are provided on the spindle under an underwinding crown; wherein an axially displaceable clamping sleeve is located between the clamping ring and the collar on the spindle; wherein the clamping sleeve can be displaced by means of an actuating device between a clamping position defined by the contact against the clamping ring and an open position defined by the contact against the collar for opening or closing a clamping cleft; and wherein the clamping sleeve is equipped with outwardly radially protruding means for the operation of the actuating elements of the actuating device and with elements for fixing the position of the clamping sleeve at least in the clamping position and for the application of a clamping force; wherein the actuating elements and the radially protruding means are held together elastically on the clamping sleeve radially to the spindle axles via angular surfaces; and wherein the direction of action of the actuating elements relative to the clamping sleeve can be switched over in such a way that, depending on the programme of the spinning machine, with increasing RPM the open position and at decreasing RPM the clamping position can be activated.

The combined non-positive and partly positive clutch between the actuating elements and the clamping sleeve allows the forces of the clamping sleeve on the clamping ring resp. on the collar of the spindle during the opening procedure to be reliably overcome. The actuating elements release the additional fixing between clamping sleeve and clamping ring and push the clamping sleeve into the open position. Opening of the clamping cleft happens at an especially favourable moment, i.e. at the end of the first downwardly directed ring rail lift at a relatively low speed and it remains open during the complete cop spinning procedure. Throwing off of the yarn waste is done during a long period of time at high spindle speeds. In addition, this procedure is supported by repeated blowing and suction processes on the open clamping cleft by means of the conventional travelling cleaner.

During the preparation phase for the cop change, the underwinding thread can be inserted in the still open clamping cleft, which is completely free from yarn waste, at an especially low speed, e.g. lower than 2000/min. Once the underwinding is finished, the actuating element, after having changed the direction of action on the clamping sleeve and after having jumped downwards over the radially protruding elements of the clamping sleeve, pulls the clamping sleeve upwards into the clamping position. After having reached this position, the actuating elements again jump over the radially protruding elements of the clamping sleeve and the clamping force required for carrying out the cop change is taken over by the means for fixing the clamping sleeve in the clamping position.

The essence of the claimed invention consists of the fact that the underwinding thread is placed at low spindle speed into a clamping cleft which is reliably free from yarn waste and sufficiently open.

According to an especially useful design of the invention the actuating elements are located on the ring rail; the radially protruding means on the clamping sleeve and/or the actuating elements have radially effective angular surfaces in both relative directions of motion; and the effective movement of the ring rail for closing the clamping cleft is bigger than the maximum width of the clamping cleft. The ring rail is especially suitable for receiving the actuating elements, as they are directly involved in the formation of the underwinding thread. Only a modification of the cycle of motion is required.

According to a favourable design variant of the invention, the actuating elements of each spindle consist of a group of radially moveable, resilient actuating elements which are arranged around the spindle axle on the lower surface of the ring rail and which elastically cooperate with the radially protruding means of the clamping sleeve. This design of the actuating elements avoids a one-sided or eccentrical load on the spindles.

A simple design of the actuating elements is achieved by the fact that the angular surfaces are part of the actuating elements.

The object of this invention is also achieved in a surprisingly easy way by a yarn clamping device for underwinding yarns on spindles of a ring spinning or ring twisting machine, wherein on the spindle below an underwinding crown a clamping ring and at a distance therebelow a radially protruding collar are provided; wherein an axially displaceable clamping sleeve is located between the clamping ring and the collar on the spindle; wherein the clamping sleeve can be displaced by means of an actuating device between a clamping position defined by the contact against the clamping ring and an open position defined by the contact against the collar for opening or closing a clamping cleft; and wherein the clamping sleeve is equipped with radially extending means for the operation of the actuating elements of the actuating device and with elements for fixing the position of the clamping sleeve at least in the clamping position by applying a clamping force; wherein the yarn clamping device is characterized in that the actuating devices are located on the spindles; and the actuating elements consist of centrifugal elements which slide in guides which are radially oriented with respect to the spindle axle and participate in the rotation of the spindle; which cooperate with angular surfaces or conical ring surfaces on the spindle or on the clamping sleeve; and which act against spring elements which, on the one hand, are supported by the collar of the spindle and, on the other hand, press the clamping sleeve into the clamping position.

The combination of the centrifugal elements acting against the spring and the elements for fixing the clamping sleeve in the clamping position allows the use of a very weak spring as it does not have to provide the necessary clamping force for the cop change. The underwinding procedure can also be executed at very low speeds and with a reliably opened and cleaned clamping cleft. It is possible to limit the winding yarn to a circumference angle of less than 360° without abruptly stopping the machine.

According to an example of the invention, the guides of the centrifugal elements are located on the clamping sleeve and the angular surfaces or conical ring surface are located on the collar of the spindle.

According to another alternative design of the invention, the guides of the centrifugal elements are located on the collar of the spindle and the angular surfaces or the conical ring surface are located on the clamping sleeve. The advantage of this design is the very compact design and low risk of fouling. It is moreover advantageous when the elements for fixing the clamping sleeve and for applying a clamping force are permanent magnets which are integrated in the clamping sleeve.

In accordance with a preferred embodiment of the invention, the elements for fixing the position of the clamping sleeve and applying a clamping force in the clamping position or for fixing the position of the clamping sleeve in the open position are formed by radially acting spring push buttons in the shaft of the spindle in cooperation with fixing grooves on the inner surface of the clamping sleeve, whereby the fixing grooves have a mutual spacing in the axial direction that is at most equivalent to the width of the open clamping cleft.

The use of permanent magnets which are integrated in the clamping sleeve as elements for the fixing of the clamping sleeve and the application of a clamping force allows designing a structurally simple and functionally very reliable embodiment for the fixing of the clamping sleeve at least in the clamping position to be provided. The magnets produce a reliably high clamping force in the clamping position.

BRIEF DESCRIPTION OF THE SEVERAL VIEWS OF THE DRAWING

The invention shall be explained in more detail below with reference to some exemplary embodiments. The corresponding drawings show FIG. 1 a cross section of the middle part of the spindle with its relation to the ring rail.

DESCRIPTION OF THE INVENTION

Figure 1:
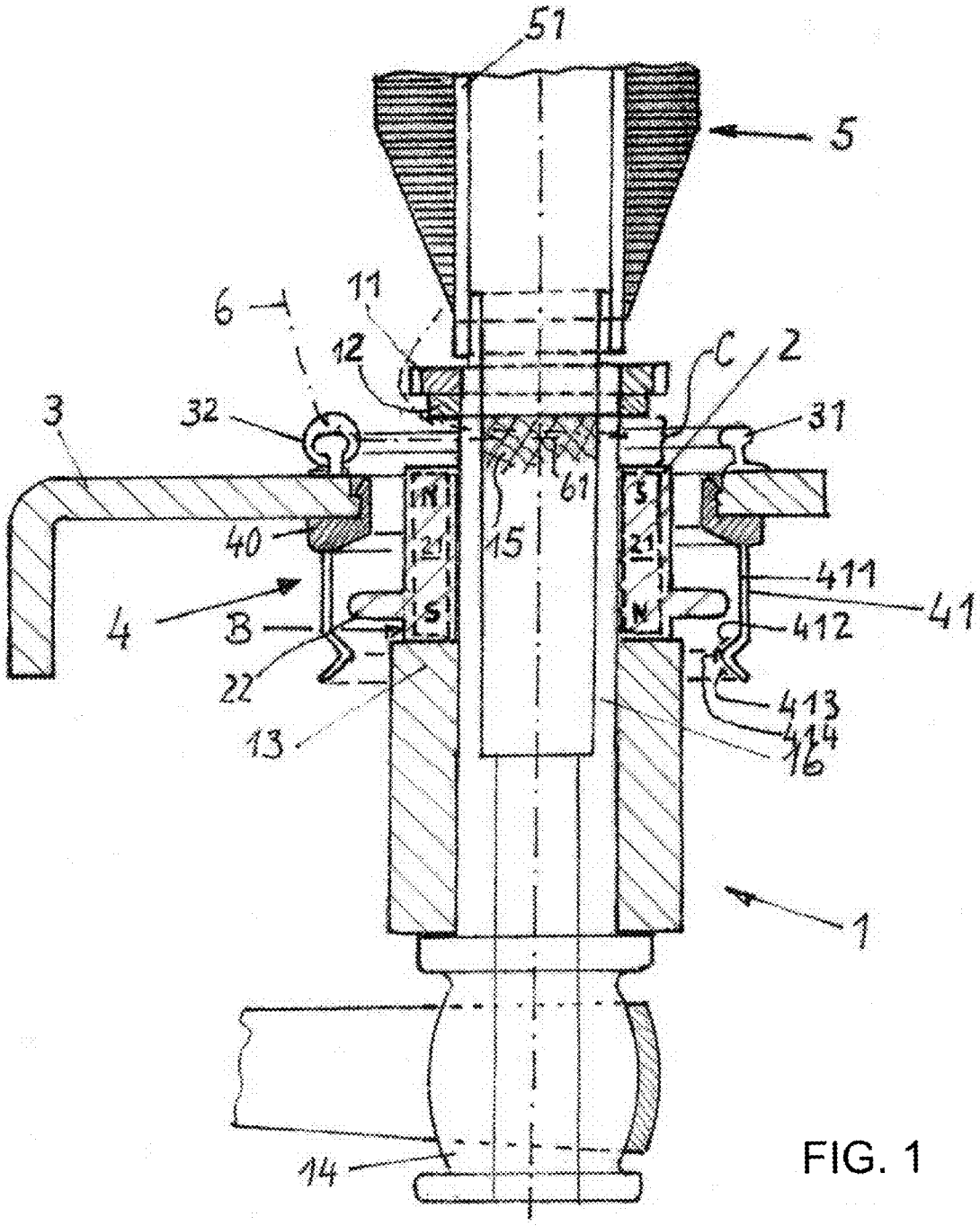

FIG. 1 shows the middle part of spindle 1 of a ring spinning machine in a simplified cross section drawing. The support (not shown) of spindle 1 firmly connected with the machine frame shows, starting from the bottom, wharve 14. The sleeve guided thereabove on shaft 16 forms collar 13, of which the upper fore-part limits the path of clamping sleeve 2 at the lower end. At the upper end, the path of the clamping sleeve 2 is limited by clamping ring 12 which is firmly connected to underwinding crown 11 and shaft 16.

The lower end of tube 51 for cop 5 to be wound is placed on the top end of shaft 16. Other upwardly extending guiding elements for the tube are not shown.

Clamping sleeve 2 is equipped with magnets 21 which can fix clamping sleeve 2 on clamping ring 12 in the clamping position A or on collar 13 in the open position B. The way in which this is done is described in more detail in publication EP 1 218 577 B1.

The position change of clamping sleeve 2 from the open position B to the clamping position A and vice versa requires in any case additional adjustment means which release the fixing in one position and move the clamping sleeve into the range of activity of the other fixing elements.

FIG. 1 shows clamping sleeve 2 in the open position B. In the area of clamping cleft C underwinding zone 15 is emphasized on the surface of shaft 16.

Ring rail 3 in the phase of FIG. 1 is lowered in underwinding position. Traveller 32 moves on spin ring 31 at the level of clamping cleft C and underwinding zone 15 and forms the underwinding spirals with the thread. The underwinding encircles shaft 16 of spindle 1 by less than 360°.

In the bore on ring rail 3, through which spindle 1 extends, actuating device 4 for each spindle 1 is inserted from below. Its holding ring 40 extends with its hook-shaped elements through said bores of ring rail 3.

Leaf-like springs 411 adjoin the holding ring 40 towards the bottom; on their downwardly directed free end there are angular surfaces 412, 413 directed inwards for the radially outwardly directed means resp. collar 22 of clamping sleeve 2.

Figure 2:
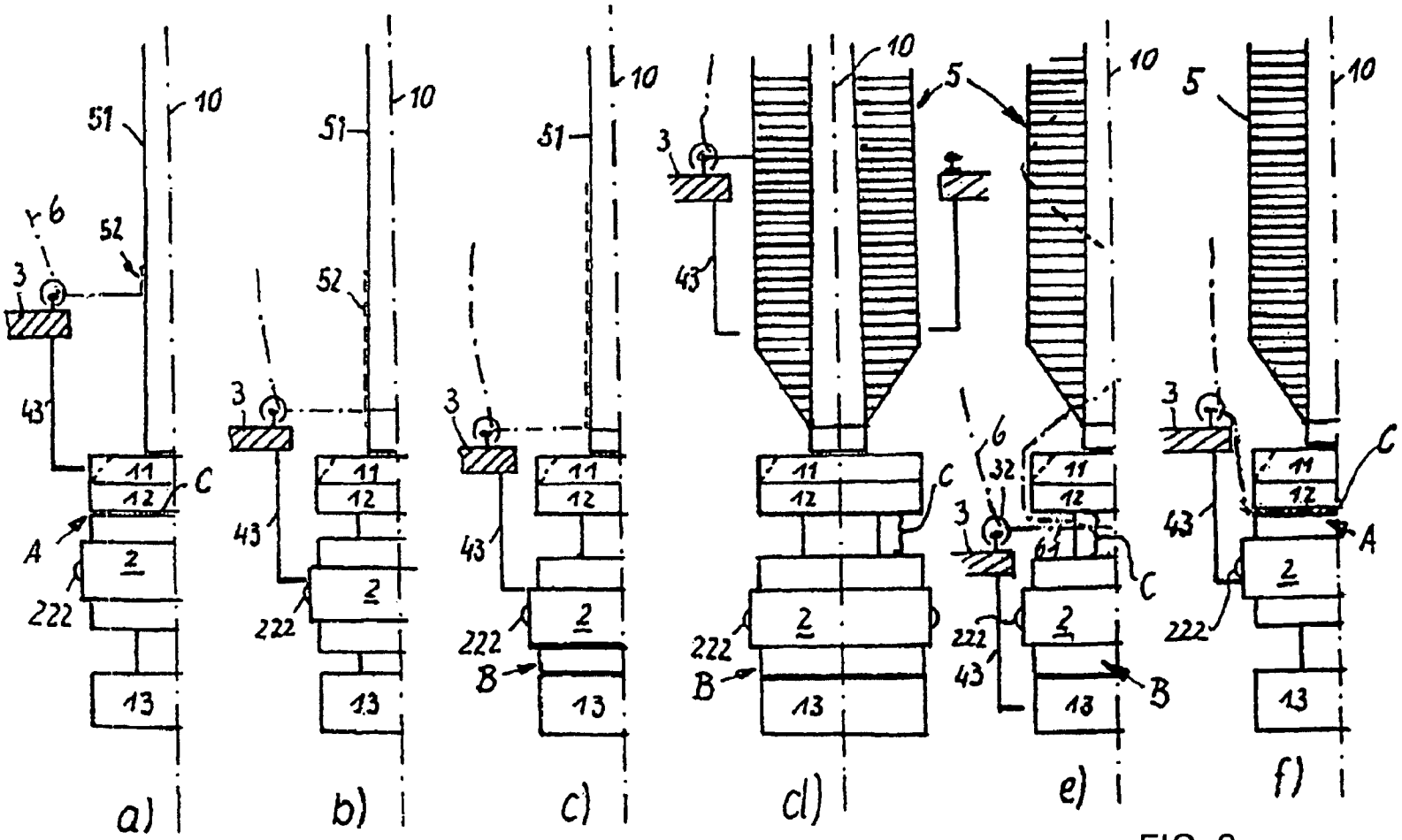
FIG. 2 the action of the clamping sleeve controlled by the ring rail during the cop building cycle in six successive phases a) to f)

The functioning of ring rail 3 with actuating device 4 and clamping sleeve 2 is shown in FIG. 2 in several phases a) to f). Phase a) shows that a new sleeve 51 has just been placed. Spindle 1 is starting to rotate again. Ring rail 3 is lifted to form the first layer and tensions the yarn held in the closed clamping cleft C as far as the first upper winding of the first yarn layer of the new bobbin 5.

In the following phase b) ring rail 3 is lowered to finish the first double yarn layer. It leads fixing element 43 which is firmly connected to it to a ball 222 (cf. FIG. 4) radially guided in clamping sleeve 2. The angular surface 2221 effective on the surface of this ball 222 is caught by actuating element 43 and moves clamping sleeve 2 downwards into the area where the force of magnets 21 and the inherent mass of clamping sleeve 2 moves clamping sleeve 2 further into the open position B. Clamping cleft C is then open.

This state is also maintained in phases c) and d). The yarn waste within clamping cleft C is torn at high speed at underwinding crown 11 and thrown off. The yarn waste will be removed by means of a blowing and/or suction device (not shown). In fact, the whole cop winding cycle can be used for this procedure.

After the winding of cop 5 is finished, phase e), ring rail 3 lowers into the underwinding position. Traveller 32 of spin ring 31 leads yarn 6 around underwinding zone 15 into the still open clamping cleft C and forms underwinding 61. Actuating element 43 overcomes, by means of the resistance of collar 13 in the open position of clamping sleeve 2, the ball 222, which is resilient in a radially inwards direction, of clamping sleeve 2 and positions itself below the resilient ball 222.

As soon as underwinding 61 is finished, delivery section and spindles 1 are stopped. Ring rail 3 moves upwards again. Actuating element 43 positions itself on the lower angular surface 2222 of ball 222 and lifts clamping sleeve 2 by overcoming the magnetic force between clamping sleeve 2 and collar 13. Clamping sleeve 2 moves into the clamping position A and fixes the underwindings 61 by the action of the magnets 21 in clamping cleft C.

Cop change can be carried out. When removing cop 5 the yarn is torn or cut between clamping cleft C and cop 5. This process starts again with phase a) after cop change has been completed.

FIGS. 3 to 7 show other embodiments of the elastic actuating elements and radially protruding means on clamping sleeve 2.

Figure 3:
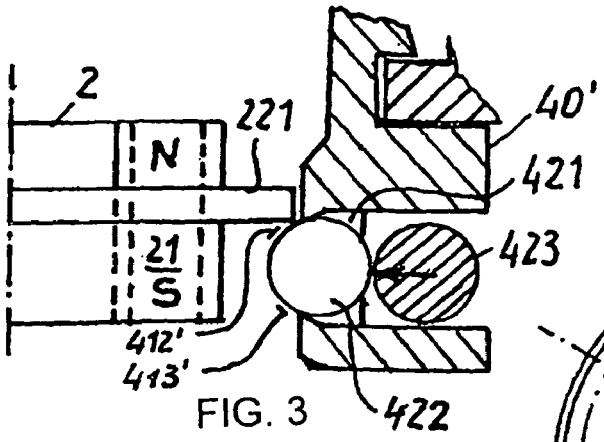
FIG. 3 an embodiment with ball-shaped actuating elements.
Figure 6:
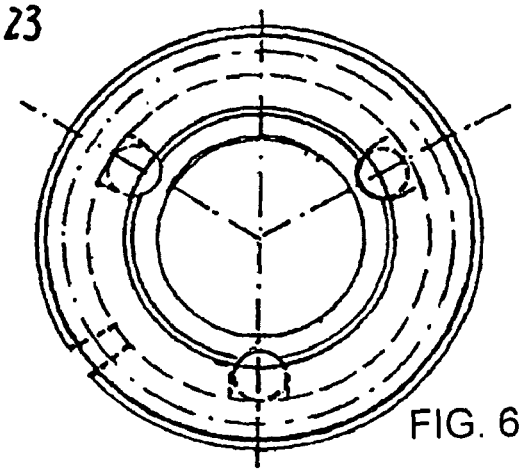
FIG. 6 a schematic top view of the drawing according to FIG. 3.

FIG. 3 and FIG. 6 show a clamping sleeve 2 with rigid collar 221. Actuating element 42 has, on its holding ring 40', radially directed bores 421, which are tapered inwards. The taper forms a stopper for ball 422. Annular spring 423, which is guided in a circumferential groove of holding ring 40', holds three of these balls 422 which are located at a mutual spacing of 120° elastically inwards on the mentioned stoppers. The parts of ball 422 protruding from the inner side of the bores 421 form the angular surfaces 412' and 413'. This embodiment guarantees a high functional safety and allows a simple exchange of the balls 422 which are subject to wear.

Figure 4:
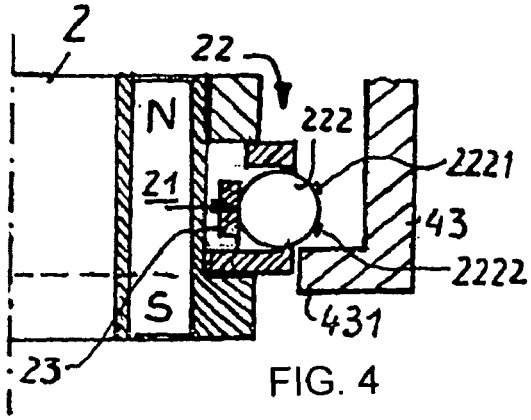
FIG. 4 an embodiment in which the radially protruding means on the clamping sleeve consist of elastically supported balls.

In FIG. 4, actuating element 43 is stably fixed to ring rail 3. The radially resilient ball 222 is pressed from inside to outside to the stoppers by annular spring 23. The characteristics of this design are similar to those as described in FIG. 3 with the limitation that the labour for exchanging the balls 222 is slightly higher.

Figure 5:
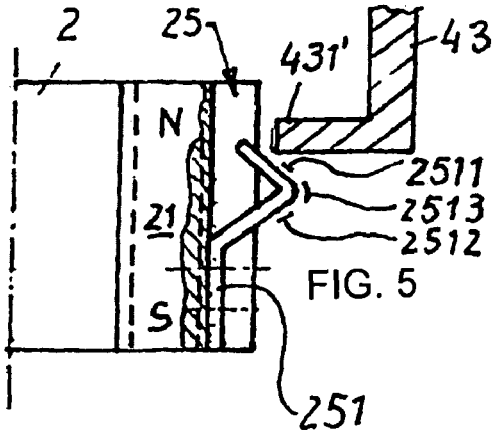
FIG. 5 an embodiment in which radially resilient leaf springs are provided on the clamping sleeve.

The device as per FIG. 5 is similar to the one as per FIG. 4. Also in this case the actuating element 43 is stable and has a rigid collar 431 directed to the inside. Actuating element 43 is firmly connected with ring rail 3. The function of the ball 222 is carried out by an angularly bent leaf spring 251 which is fixed in a groove 25 of clamping sleeve 2. The angular surfaces 2511 and 1512 are formed on leaf spring 251. The vertex 2513 in between is very narrow and guarantees a safe movement of clamping sleeve 2 in all phases.

Figure 7:
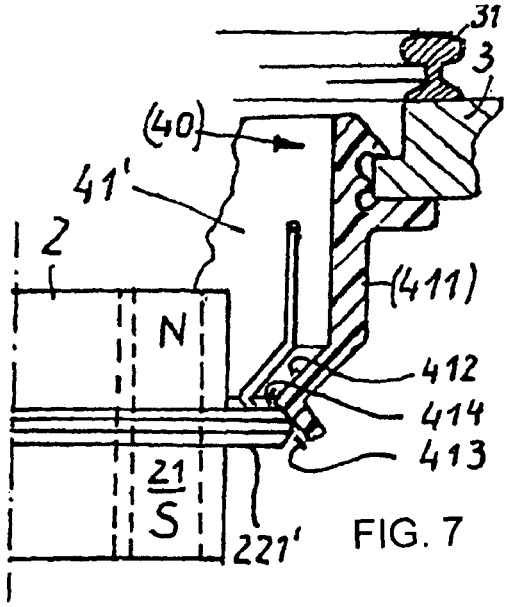
FIG. 7 a variant in which the actuating elements are made of a sleeve of synthetic material, the surface lines of which are slotted from the free, lower end.

FIG. 7 shows another preferred embodiment. Clamping sleeve 2 has a fixed collar 221'. Actuating element 41' is made in one piece as a sleeve and includes the functions and elements of the holding ring 40 and the springs 411. Sleeve 41' is preferably a part made from synthetic material. The section directed downwards which carries out the functions of spring 411, is slotted along surface lines, so that the shell segments can spring individually. On their lower end, the shell segments form the angular surfaces 412, 413 and vertex 414. Depending on the characteristics of the synthetic material of sleeve 41', two or more shell segments are formed as springs 411 on the circumference of sleeve 41'.

Apart from these described embodiments, additional advantageous alternatives are possible within the context of the present invention. For example, instead of the balls 222 or 422 also the spring push buttons known in specialist fields as "Novibraknöpfe" (Novibra buttons) can be used. In the following text, these parts will be called spring push buttons (17).

In the case of these spring push buttons, a unit consisting of three elements (sleeve/spring/bowl), instead of the balls, bowl-shaped calotte shell segments are pressed against the actuating element 43 (FIG. 4) or against the collar 221 of clamping sleeve 2 by means of spiral springs.

Instead of balls or bowls made of steel, also other materials, e.g. synthetic materials, can be used.

Publication EP 1 218 577 B1 described that, by means of certain arrangements of magnets in clamping sleeve 2 and in collar 13 when twisting the clamping sleeve 2 with respect to the collar 13, an axial shifting of clamping sleeve 2 will be achieved. In the described embodiment magnetic poles with different polarity and attracting action are located opposite to each other at closed clamping position within the clamping cleft. When the actuating device touches the collar 221 of clamping sleeve 2, it brakes first of all the clamping sleeve 2. Clamping sleeve 2 twists against spindle 1. With this, the poles in the clamping cleft of same polarity are initially opposing one another and repelling each other. Clamping sleeve 2 is pushed downwards in the direction of open position B. At the same time poles of different polarity are approaching each other at the bottom between clamping sleeve 2 and collar 13. These are attracting each other and support the movement of clamping sleeve 2 into the open position B. Afterwards the poles of different polarity stabilize the open position B.

If the ring rail 3 is brought into the underwinding position, the actuating element 41 jumps over collar 221 of clamping sleeve 2. The underwinding yarn which has in the meantime been inserted is clamped into clamping cleft C at the next upward movement of ring rail 3 when spindles 1 and delivery section are stopped. Between clamping sleeve 2 and clamping ring 12 poles of different polarity approach each other. Thereby they initiate a turning of clamping sleeve 2 with respect to spindle 1. Clamping sleeve 2 and clamping ring 12 realign themselves in circumferential direction. The necessary clamping force for the underwinding yarn spirals can be generated.

In this case, upon opening of clamping cleft C the actuating element 4 of ring rail 3 does not execute a direct adjusting motion between clamping position A and open position B, but only transmits a braking impulse which allows the magnets to change the position of the clamping sleeve 2.

Figure 8A:
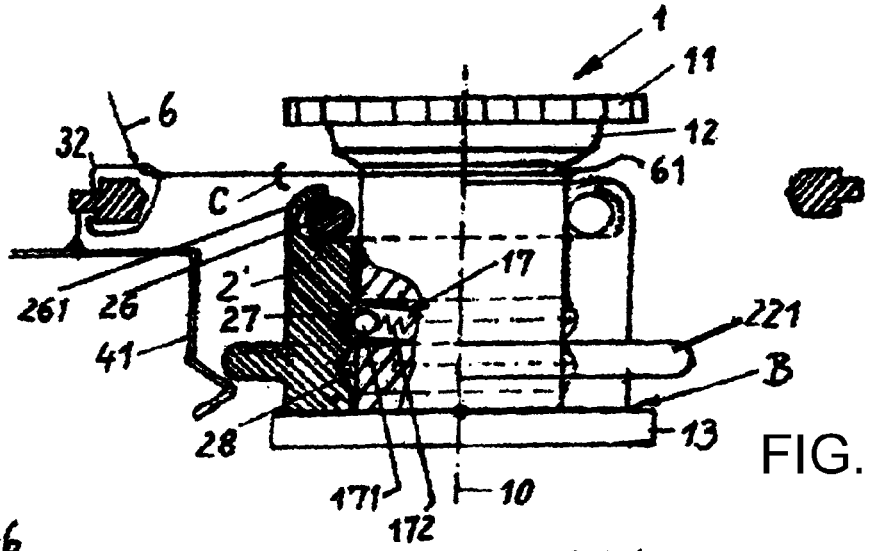
FIG. 8*a*, b, c three positions of a variant (a) underwinding, b) clamping, c) spinning) in which the clamping sleeve is allocated mechanical elements for the fixing in the end positions.
Figure 8B:
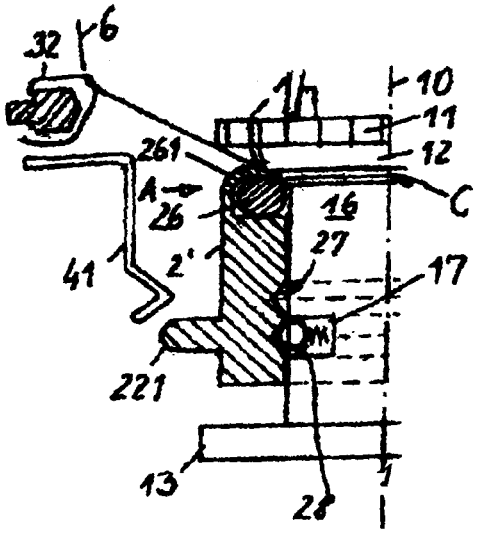
Figure 8C:
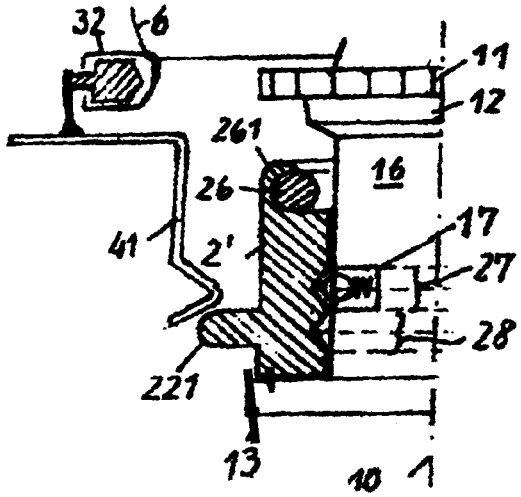

FIGS. 8*a*, 8*b*, 8*c* show another alternative of the device of the invention. Instead of the magnets 21 described in relation to FIG. 1, the already described spring push buttons 17 are used for fixing the clamping sleeve 2' in the clamping position A resp. in the open position B. Spring push buttons 17 are radially inserted in the shafts 16 of spindle 1. The ball segments of ball 171 protruding outwards or the protruding segments of the bowls or calotte shells (not shown) grip elastically into the fixing grooves 27 resp. 28 and fix the position of clamping sleeve 2' in the clamping position A or in the open position B.

This kind of fixing of the clamping sleeve 2' allows the use of so-called O-rings 26 in the clamping area. The hoop 261 which embraces the O-ring 26 externally and partly from the top allows, due to its shape and configuration, space for the radial extension of the elastic O-ring 26 so that it can additionally fix the underwinding spirals in the clamping position A as shown in FIG. 8*b*. When the ring rail 3 reaches the underwinding position after cop winding, as shown in FIG. 8*a*, the spring of the actuating element 41 jumps over the collar 221 of clamping sleeve 2' and positions itself below collar 221.

The spring push button 17 is located in the fixing groove 27 and still secures the open position B.

In the position according to FIG. 8*b* the ring rail 3 has lifted itself into the position required for the cop change. The spring of actuating element 41 has firstly displaced the clamping sleeve 2' into clamping position A. The spring push button 17 now secures the position of the clamping sleeve 2' by locking it in fixing groove 28.

When continuing to move upwards, the spring of actuating element 41 overcomes the collar 221 of clamping sleeve 2' and leaves the area of movement of clamping sleeve 2'.

After having finished the first yarn layer, the ring rail 3 with the actuating element 41 hits the collar 221 from above and displaces the clamping sleeve 2' into a position in which it is shifted into the open position by the spring push button 17 in cooperation with fixing groove 27 and is fixed there.

Figure 9A:
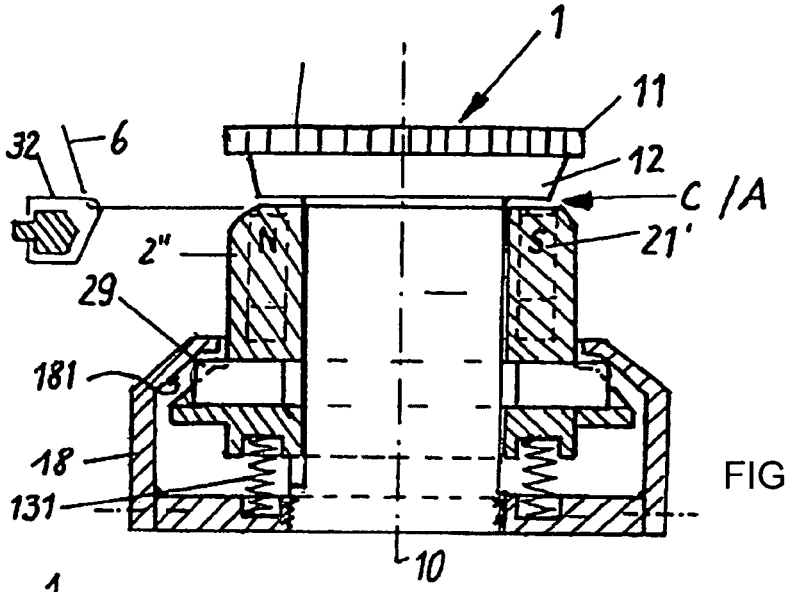
FIG. 9*a*, b, c three positions of another alternative of the invention in which the actuating elements are centrifugal elements which rotate together with the spindle.
Figure 9B:
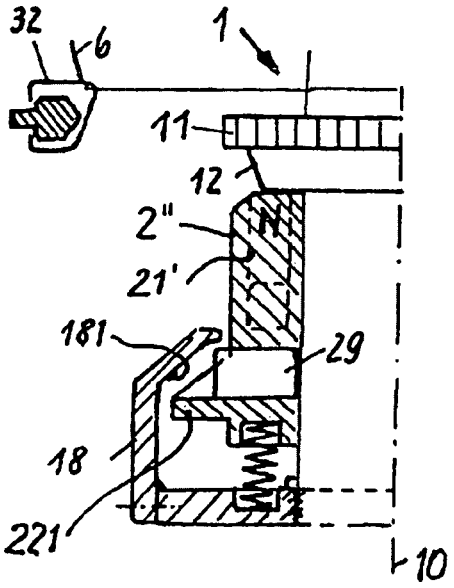
Figure 9C:
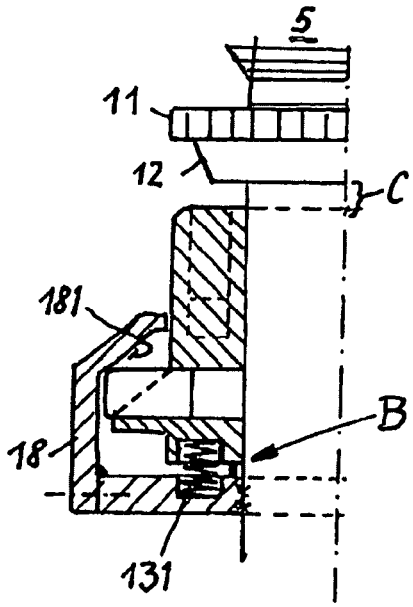

FIGS. 9*a*, 9*b*, 9*c* show another solution for the object to be achieved according to this invention. As shown in FIG. 1, an actuating bush 18 is mounted axially non-displaceably and torsionally rigid on spindle 1 in the area of the collar 13. The upwardly directed walls overlap the lower area of the clamping sleeve 2" on the outside and form an inwardly and downwardly directed angular surface 181.

The radially protruding means 22' of clamping sleeve 2" are equipped with radial guides in which the radially freely moving centrifugal elements 29 are inserted. The outer upper edge of these centrifugal elements 29 is in contact with the angular surface 181 when the spindle 1 is rotating.

There are magnets 21' inserted, in clamping sleeve 2", the poles of which are directed towards the clamping cleft C. They assist the clamping pressure when they are close to the clamping ring 12. Clamping sleeve 2" is supported with its lower end on spring elements 131 which, in turn, are supported in bores of the actuating bush 18. These spring elements 131 keep clamping sleeve 2", during standstill of the spindle at a low clamping pressure, in clamping position A. The magnets 21' provide the necessary clamping force which allows the tearing off of the yarn as shown in FIG. 9*b*.

The functioning of the device as per FIG. 9 is the following. When the spindle speed has lowered to approx. 2000 rpm, the traveller 32 leads the thread into the underwinding area. Clamping cleft C is open. It can take up the underwinding yarn in an exactly defined length without problems.

If the spindle is stopped, as shown in FIG. 9*b*, the force generated by the centrifugal elements 29 on the angular surface 181 is reduced. The spring elements 131 displace clamping sleeve 2" into clamping position A. The magnets 21' provide the necessary clamping force. The cop change can take place. The yarn between cop and clamping cleft C is torn or cut.

As soon as the spinning process is started on the new cop, the spindle speed increases. The centrifugal elements 29 are pressed to the angular surfaces 181 and push clamping sleeve 2" against the direction of action of spring 131 downwards into the open position B. Clamping sleeve 2" remains in this position until the next cop change begins, starting with a decrease of the spindle speed. There is sufficient time left to throw off and remove the yarn waste from the open clamping cleft C.

Figure 10A:
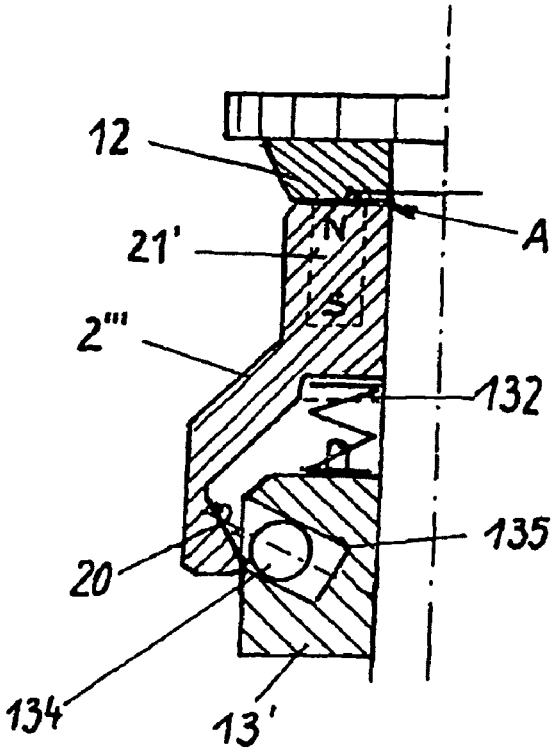
FIG. 10*a, b* two positions of a variant in which the centrifugal elements are ball-shaped and guided on parts of the collar of the spindle.
Figure 10B:
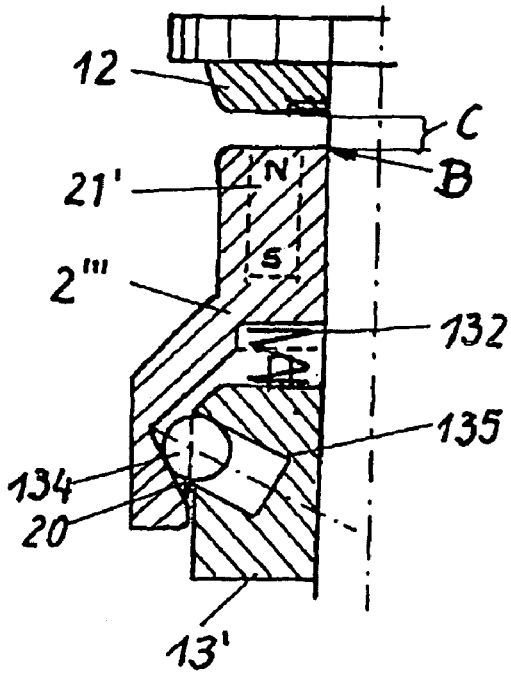

The device according to FIGS. 10*a* and 10*b* shows an embodiment in which balls 134 are used as centrifugal elements. They are guided in bores 135 radially directed outwards and upwards in collar 13' of spindle 1.

The clamping sleeve 2''' overlaps this part of the collar 13' on the spindle and forms on the inside a conical ring surface 20 directed inwards and downwards. The upper part of clamping sleeve 2''' is positively guided on the spindle and can freely move in axial direction between open position B and clamping position A. In this area of the clamping sleeve 2''' magnets 21' are arranged which work together with the clamping ring 12 of the spindle.

A pressure spring 132 is supported at the bottom on the collar 13' of the spindle and at the top on the clamping sleeve 2'''. The spring is designed in such a way that it can push the clamping sleeve 2' as far as clamping position A. The required clamping force for the underwound threads is mainly provided by the magnet 21'.

FIG. 10*a* shows the device in clamping position A. During standstill of the spindles and at relatively low spindle speeds (below 5000/min), the balls 134 serving as centrifugal elements are not capable of opening the clamping cleft C, i.e. cannot overcome the adhesive force provided by the magnets 21' and the force of pressure spring 132. During the spinning process, at speeds above approx. 5000/min. the balls 134 can, assisted by the inherent weight of the clamping sleeve 2''', firstly by overcoming the adhesive force of the magnets 21' and against the action of the rather small spring 132, move downwards. Clamping cleft C opens and clamping sleeve 2''' assumes the open position B as shown in FIG. 10*b*.

After having finished bobbin 5, ring rail 3 is lowered into the underwinding position and the speed of spindles 1 is reduced to approx. 2000/min. At around this low speed the centrifugal force of the balls 134 can still safely overcome the low force of the pressure spring 132 and can reliably keep the clamping cleft C open. At this speed the underwinding yarn can be produced in a manner limited to less than 360°.

This low speed also makes it possible to further slow down the spindle and the delivery speed of the drafting system in an appropriate time almost synchronously to zero; without increasing the underwinding yarn to an unacceptable extent.

Due to the decreasing centrifugal forces of the balls 134, the spring 132 can guide the clamping sleeve 2''' into clamping position A again. When the clamping cleft is closing, the magnet 21' generates the main portion of the clamping force needed for an error-free cop change.

The magnets 21' should be e.g. designed in such a way that the holding force exerted by them at almost closed clamping cleft C is higher than the difference of the pressure force of the spring elements 132 between open position B and clamping position A.

Figure 11:
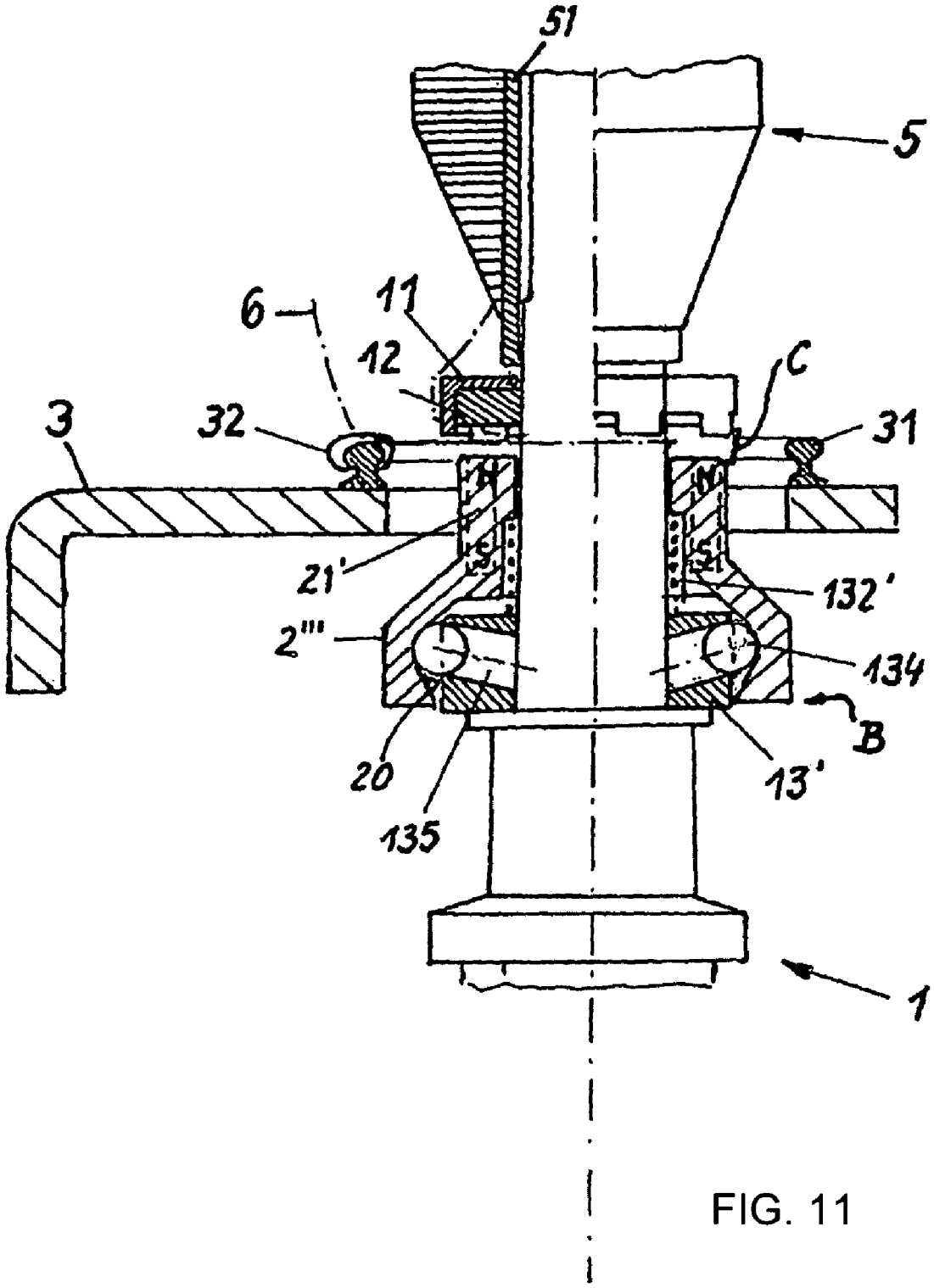
FIG. 11 a successfully tested clamping device according to the principle of FIG. 10*a* and FIG. 10*b* in a view on the basis of FIG. 1.

FIG. 11 shows a clamping device built according to the principle of FIGS. 10*a* and 10*b* in a view analogue to FIG. 1.

Instead of the springs 132 a single spring 132' takes over the movement of the clamping sleeve 2'''' into clamping position A. The simple construction design of clamping sleeve 2'''' and the hidden actuating elements, consisting of collar 13', ball-shaped centrifugal elements 134, ring surface 20 and the spring 132", can be clearly seen.

LIST OF REFERENCE NUMERALS

1 Spindle
10 Spindle axle
11 Underwinding crown
12 Clamping ring
13, 13', 13" Collar
131 Spring element
132, 132' Spring/spring element
134 Ball/centrifugal element
135 Ball guide
14 Wharve
15 Underwinding zone
16 Shaft
17 Spring push button
171 Ball
172 Spring
18 Actuating bus
181 Angular surface
2, 2', 2", 2''', 2'''' Clamping sleeve
20 Ring area, conical
21, 21' Magnets

22 Radially protruding means
221, 221' Collar
222 Ball
2221 Angular surface
2222 Angular surface
23 Annular spring
24 Bore
25 Groove
251 Leaf spring
2511 Angular surface
2512 Angular surface
2513 Vertex
26 O-ring
261 Hoop
27 Fixing groove (open position)
28 Fixing groove (clamping position)
29 Centrifugal elements
3 Ring rail
31 Spin ring
32 Traveller
4 Actuating device
40, 40' Holding ring
41 Actuating element
41' Actuating element, sleeve
411 Spring
412, 412' Angular surface
413, 413' Angular surface
414 Vertex
42 Actuating element
421 Bore
422 Ball
423 Annular spring
43, 43' Actuating element
431, 431' Collar, inner side
5 Cop
51 Tube
52 First layer
6 Yarn
61 Underwinding
A Clamping position
B Open position
C Clamping cleft
N North pole
S South pole

The invention claimed is:

1. Yarn clamping device for underwinding yarns on spindles of a ring spinning or ring twisting machine, wherein on the spindle below an underwinding crown a clamping ring and at a distance therebelow a radially protruding collar are provided;

wherein at a distance between the clamping ring and the collar an axially displaceable clamping sleeve is located on the spindle;

wherein the clamping sleeve can be displaced by means of an actuating device between a clamping position defined by the contact against the clamping ring and an open position defined by the contact against the collar for opening or closing a clamping cleft; and wherein the clamping sleeve is equipped with radially protruding means for the operation of the actuating elements of the actuating device and with elements for fixing the position of the clamping sleeve at least in the clamping position and the application of a clamping force;

wherein the actuating elements and the radially protruding means are held together elastically on the clamping sleeve radially to the spindle axles via angular surfaces; and wherein the direction of action of the actuating elements relative to the clamping sleeve can be switched over in such a way, that, depending on the programme of the spinning machine, with increasing RPM the open position and at decreasing RPM the clamping position can be activated.

2. The device according to claim 1, characterized in that the actuating elements are located on the ring rail;

the radially protruding means on the clamping sleeve and/or the actuating elements have radially effective angular surfaces in both relative directions of motion; and that the effective movement of the ring rail for closing the clamping cleft is bigger than the maximum width of the clamping cleft.

3. The device according to claim 1, characterized in that the actuating elements of each spindle consist of a group of radially movable, resilient actuating elements which are arranged around the spindle axle on the lower surface of the ring rail and which elastically cooperate with the radially protruding means of the clamping sleeve.

4. The device according to claim 1, characterized in that the angular surfaces are part of the actuating elements.

5. Yarn clamping device for underwinding yarns on spindles of a ring spinning or ring twisting machine, wherein on the spindle below an underwinding crown a clamping ring and at a distance therebelow a radially protruding collar are provided;

wherein at a distance between the clamping ring and the collar an axially displaceable clamping sleeve is arranged on the spindle;

wherein the clamping sleeve can be displaced by means of an actuating device between a clamping position defined by the contact against the clamping ring and an open position defined by the contact against the collar for opening or closing a clamping cleft; and wherein the clamping sleeve is equipped with radially extending means for the engagement of the actuating elements of the actuating device and with elements for fixing the position of the clamping sleeve at least in clamping position and the application of a clamping force characterized in that the actuating devices on the spindles are located on the spindles; and that the actuating elements consist of centrifugal elements which slide in guides which are radially oriented with respect to the spindle axle and participate in the rotation of the spindle;

which cooperate with angular surfaces or conical ring surfaces on the spindle or on the clamping sleeve; and which act against spring elements which, on the one hand, are supported by the collar of the spindle and, on the other hand, press the clamping sleeve into the clamping position.

6. The yarn clamping device according to claim 5, characterized in that the guides of the centrifugal elements are located on the clamping sleeve; and that the angular surfaces or the conical ring surface are located on the collar of the spindle.

7. The yarn clamping device according to claim 5, characterized in that the guides of the centrifugal elements are located on the collar of the spindle; and that the angular surfaces or the conical ring surface are located on the clamping sleeve.

8. The device according to claim 1, characterized in that the elements for fixing the clamping sleeve and for applying a clamping force are permanent magnets which are integrated in the clamping sleeve.

9. The device according to claim 1, characterized in that the elements for fixing the position of the clamping sleeve and for applying a clamping force in the clamping position or for fixing the position of the clamping sleeve in the open position are formed by radially acting spring push buttons in the shaft of the spindle in cooperation with fixing grooves on the inner surface of the clamping sleeve, whereby the fixing grooves have a mutual spacing in the axial direction that is at most equivalent to the width of the open clamping cleft.

* * * * *